US006076967A

United States Patent [19]

Beaudette

[11] Patent Number: 6,076,967

[45] Date of Patent: Jun. 20, 2000

[54] FILLABLE DISPOSABLE DRINK BAG

[76] Inventor: Susan A. Beaudette, 2733 E. Coolidge Ave., Orange, Calif. 92867

[21] Appl. No.: 09/084,920

[22] Filed: May 28, 1998

Related U.S. Application Data

[60] Provisional application No. 60/048,670, Jun. 5, 1997.

[51] Int. Cl.[7] ..... B65D 33/00

[52] U.S. Cl. ..... 383/41; 383/63; 383/66; 383/80; 383/104; 383/906

[58] Field of Search ..... 383/63, 41, 66, 383/904, 80, 103, 104, 906

[56] References Cited

U.S. PATENT DOCUMENTS

| | | | |
|---|---|---|---|
| 2,992,118 | 7/1961 | Daline . | |
| 2,998,340 | 8/1961 | Conway et al. . | |
| 3,799,914 | 3/1974 | Schmit et al. . | |
| 4,532,652 | 7/1985 | Herrington | 383/103 |
| 4,718,778 | 1/1988 | Ichikawa . | |
| 4,869,725 | 9/1989 | Schneider et al. | 383/63 X |
| 4,903,718 | 2/1990 | Sullivan | 383/63 X |
| 4,972,825 | 11/1990 | Vescovo, Jr. | 383/103 X |
| 5,035,516 | 7/1991 | Pacheco | 383/41 |
| 5,080,155 | 1/1992 | Crozier | 383/103 X |
| 5,142,970 | 9/1992 | ErkenBrack | 383/63 X |
| 5,240,112 | 8/1993 | Newburger . | |
| 5,261,532 | 11/1993 | Fauci | 383/63 X |
| 5,544,752 | 8/1996 | Cox . | |
| 5,564,591 | 10/1996 | Christine et al. | 383/80 X |

FOREIGN PATENT DOCUMENTS 495372 11/1938 United Kingdom .

*Primary Examiner*—Jes F. Pascua
*Attorney, Agent, or Firm*—Richard C. Litman

[57] ABSTRACT

A fillable, resealable, and disposable flexible liquid container which incorporates a drinking straw as a conduit for delivering fluids to a user. The container includes a pleated bottomed structure which allows it to stand upright when filled. At least one zipper closure is fitted along the upper edge of the container that permits filling of the container and prevents leaking of fluid contents in particular. The straw or tube may be built into the container and have a closure of its own, or a puncture target facilitating insertion of a straw into the container may be attached thereto.

2 Claims, 5 Drawing Sheets

FILLABLE DISPOSABLE DRINK BAG

CROSS-REFERENCE TO RELATED APPLICATION

This application claims the benefit of U.S. Provisional Patent Application Ser. No. 60/048,670, filed Jun. 5, 1997.

BACKGROUND OF THE INVENTION

1. Field of the Invention

The present invention relates to flexible containers and more specifically, to a fillable, resealable, and disposable flexible liquid container which incorporates a drinking straw or tube.

2. Description of Related Art

Flexible liquid containers having drinking straws are known in the related art. These containers are often placed within lunch bags for children and adults. Drinks of this type are often expensive making consumption thereof undesirable except for the intended purpose of providing a drink in a disposable container for use in locations removed from other more cost effective solutions.

While at home or in a similar locations, drinks can be purchased or produced in large volumes, cost effectively, and without concern over storing the large containers. Therefore, a need exists for a fillable, resealable, and disposable flexible liquid container which has a drinking straw, and which allows for the storage, transportation, and consumption of liquid beverages of the type that can be cost effectively purchased or produced in large volume.

Various types of related art are disclosed in the following:

U.S. Pat. No. 2,992,118 issued to Daline on Jul. 11, 1961; U.S. Pat. No. 2,998,340 issued to Conway et al. on Aug. 29, 1961; U.S. Pat. No. 3,799,914 issued to Schmit et al. on Mar. 26, 1974; U.S. Pat. No. 4,718,778 issued to Ichikawa on Jan. 12, 1988; U.S. Pat. No. 5,240,112 issued to Newburger on Aug. 31, 1993; U.S. Pat. No. 5,544,752 issued to Cox on Aug. 13, 1996; and British Patent Specification No. 495,372 issued to Lacour on Nov. 11, 1938.

Some related art flexible liquid containers have built in drinking straws. An elongated conduit is built into the sidewall of the container and a portion of the container may be torn away to provide access to the upper conduit end and permit the liquid contents to be removed by manual suctioning of the conduit. Unfortunately, manual suctioning of such a conduit is difficult and unavoidably involves sucking on the container. Other prior art flexible liquid containers with built in drinking straws provide an external integral spout facilitating filling of the container and emptying of the filled container. The external conduit simplifies the manual suctioning or squeezing and the emptying of the container.

Still other prior art flexible liquid containers with built in drinking straws have a container bottom that opens to form a broad base for supporting the container of fluid in a standing, upright position. In addition, some containers have an elongated dispensing member enclosed within the container which extends between a lower fluid compartment and an upper dispensing member storage compartment.

Still other related art flexible liquid containers with built in drinking straws have a delivery device that is securely attached to the container in such a way that a conduit portion extends into the interior of the liquid container. An opening formed in the conduit portion adjacent the top of the container can be closed by pinching the wall of the flexible container closing the opening thereby enabling the conduit to be used as a straw. Optionally, the opening can be used as an inlet to the conduit so that the contents of the container can be completely emptied when the container is turned upside down.

Additional related art flexible containers have a sealing assembly which extends across an opening of the container to more readily permit filling of the container. Others still, have a suction assembly that extends through the container and into fluid communication with the interior thereof to facilitate manual suctioning of air from the bag. Flexible liquid containers that do not have built in drinking straws but rather include a straw having an end adapted to puncture the flexible container are also known.

However, none of these prior art flexible containers provide dual sealing assemblies to prevent leakage of the fluid contents therein, nor do any of the prior art fillable bags provide a tubing assembly which extends into the interior of the liquid container as described herein. In addition, none of the related art flexible liquid containers that include a straw or tube having an end adapted to puncture the container are fillable by providing a resealable opening that extends across the container to more readily permit filling of the container. None of the related art flexible liquid containers that include a straw having an end adapted to puncture the container provide a device for resealing the container after its being punctured. Furthermore, the prior art flexible liquid containers are not specifically adapted for use by patients which have undergone facial or dental surgery and thereby limited to a liquid diet by an inability to introduce eating utensils into their mouths.

None of the above inventions and patents, taken either singly or in combination, is seen to describe the instant invention as claimed.

SUMMARY OF THE INVENTION

A fillable, resealable, and disposable flexible liquid container is formed by coupling a flexible lower panel to a flexible upper panel along the outer peripheral edges thereof so as to define an expansible space between the upper panel and lower panel. The container bottom is optionally pleated making it capable of supporting the container in an upright position. The panels are uncoupled relative to one another along a forward edge thereof to define an open end having an opening through which the container may be filled. The opening of the container is resealable by at least one zipper closure extending across the open end of the container. The zipper closure comprises at least one sealing strip coupled to the interior surface of the upper panel and a second sealing strip coupled to the interior surface of the lower panel and positioned for interlocking engagement with the first sealing strip.

A straw or tube having an upper end and a lower end optionally extends into the interior of the container as further discussed below. The straw is anchored to the interior of the upper panel and the lower panel, thereby placing the lower end of the straw into fluid communication with the interior of the container to allow the suctioning or squeezing of contents within the container. The straw may extend fully into the bag or it may be attached to an extension tube heat sealed into the bag, the latter being more useful when squeezing the contents from the container. The extension tube and straw have a closure for sealing the upper end of the respective ends.

In another embodiment, an adaptive means in the form of a puncture target is provided as an alternative to the extension tube. The target is coupled to the exterior of the container whereby a patch made from flexible thin sheet material having an adhesive applied to one side of the patch. The target includes an aperture in the center of the patch which is specifically adapted to receive a straw. In addition, the target may contain a translucent, thin sheet material so that it may be placed over existing punctures made within reused containers for example. Alternatively, the puncture target can be an indicia placed on the exterior of the container. In this case, the straw is specifically adapted to puncture the container through the puncture target.

The puncture target can also be located within a pocket formed by having the zipper closures extend only partially across the opening in the container and coupling the upper panel to the lower panel, proximate the terminus of the zipper closure along a line parallel to the peripheral edge of the container and coupling the upper panel to the lower panel along an adjoining line parallel to the zipper closure.

Accordingly, it is a principal object of the invention to provide a flexible liquid container with sealing assemblies to allow filling of the container and to prevent leakage of fluid contents placed therein.

It is another object of the invention to provide a fillable flexible liquid container with a built in tube assembly which extends into the interior of the liquid container for allowing suctioning of contents within the container and facilitating the squeezing of the container to force the contents therein out of the assembly by a user.

It is a further object of the invention to provide a flexible liquid container that includes a straw having an end adapted to puncture the container which is fillable by providing an open end having a resealable opening with a zipper closure which extends across the opening of the container to readily permit filling of the container.

Still another object of the invention is to provide a flexible liquid container that includes a straw or tube having an end adapted to puncture the container and a puncture target.

It is still yet another object of the invention to provide a puncture target which can be used to provide a device for resealing the container for re-use after it has been previously punctured.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a flexible drink bag or container which is resealable, refillable and disposable for various applications. The preferred use of the drink bag according to the invention is for providing fluids to dental patients during the period of post dental surgery. Other areas of application of the drink bag according to the invention include camping, biking, etc. For medical purposes, a flexible tubing (drinking straw) or conduit provides hydration, nutrition or irrigation to patients convalescing from illness or surgery. In particular, the preferred embodiment is directed to patients who have undergone Maxillo-Facial/oral surgery.

Figure 1:
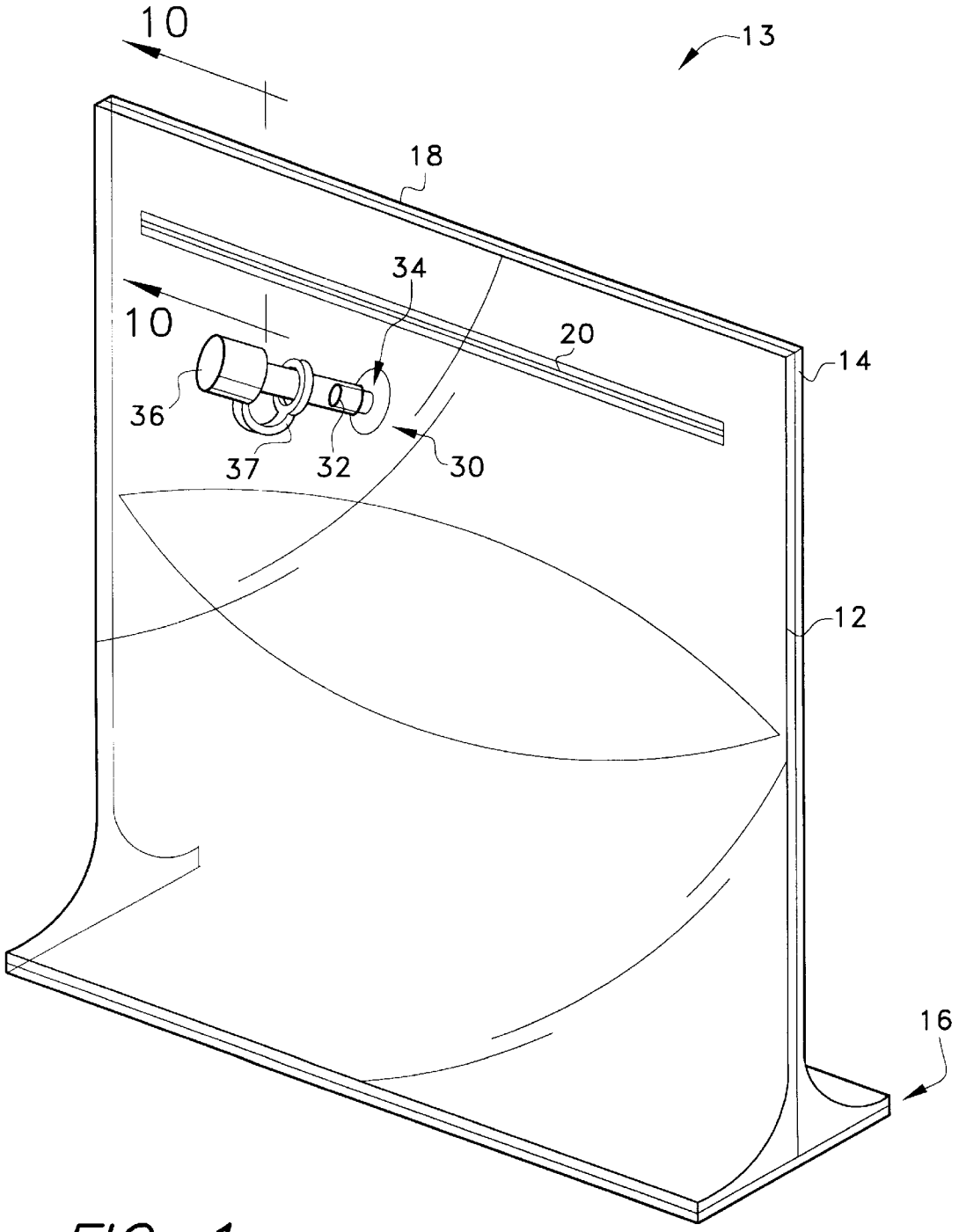
FIG. 1 is a perspective view of a fillable disposable drink container according to the present invention having a capped tubular extension.

Referring to the figures by numerals of reference, and first to FIG. 1, the fillable, resealable, and disposable flexible liquid container embodying the principles and concepts of the present invention, and generally designated by the reference numeral 13 will be described. The container 13 is formed by coupling a flexible rear panel 14 to a flexible front panel 12 along the outer peripheral edges thereof so as to define an expansible space or compartment between the front panel 12 and the rear panel 14.

Figure 8:
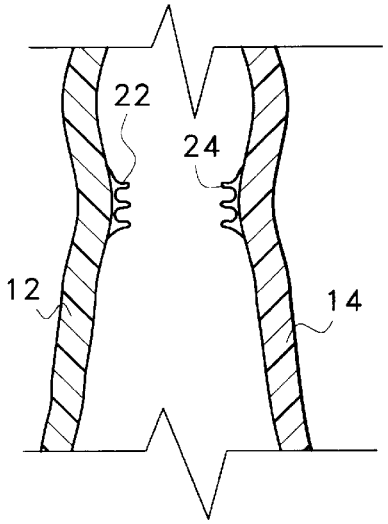
FIG. 8 is a cross-sectional view of the fillable disposable drink container along line 10—10 in FIG. 1.

The container bottom 16 is pleated making it capable of supporting the container 13 in an upright position as diagrammatically illustrated in the figure. The panels 12, 14 are uncoupled relative to one another along an open end 18 thereof to define an opening through which the container 13 may be filled. Referring to FIGS. 1 and 8, the open end 18 of the container 13 is sealed by a zipper closure 20 extending across the open end of the container. The zipper closures 20 comprises a sealing strip 22 coupled to the interior surface of the front panel 12 and to the interior surface of the rear panel 14 for interlocking engagement with between the sealing strip 22.

A heat sealed extension tube 30 having a upper end 32 and a lower end 34 is disposed within the top surface of the front panel 12 for allowing fluid to be drawn from the interior compartment of the container 13 by suctioning or squeezing. A plastic cap 36 and looped strap extension 37 are used to seal the extension during preparation or transport to a patient prior to use. The container 13 is typically prepared at a remote location within a dental office and subsequently supplied to respective patients for use. The cap 36 serves to prevent spillage during transport to a patient. The base or lower end 34 of the extension tube 30 is shown in fluid communication with the interior of the container 13 to allow suctioning or squeezing of the contents therein. The various types of closures disclosed and described herein are provided for illustrative purposes only and are not intended in any way to limit the scope of the appended claims.

Figure 2:
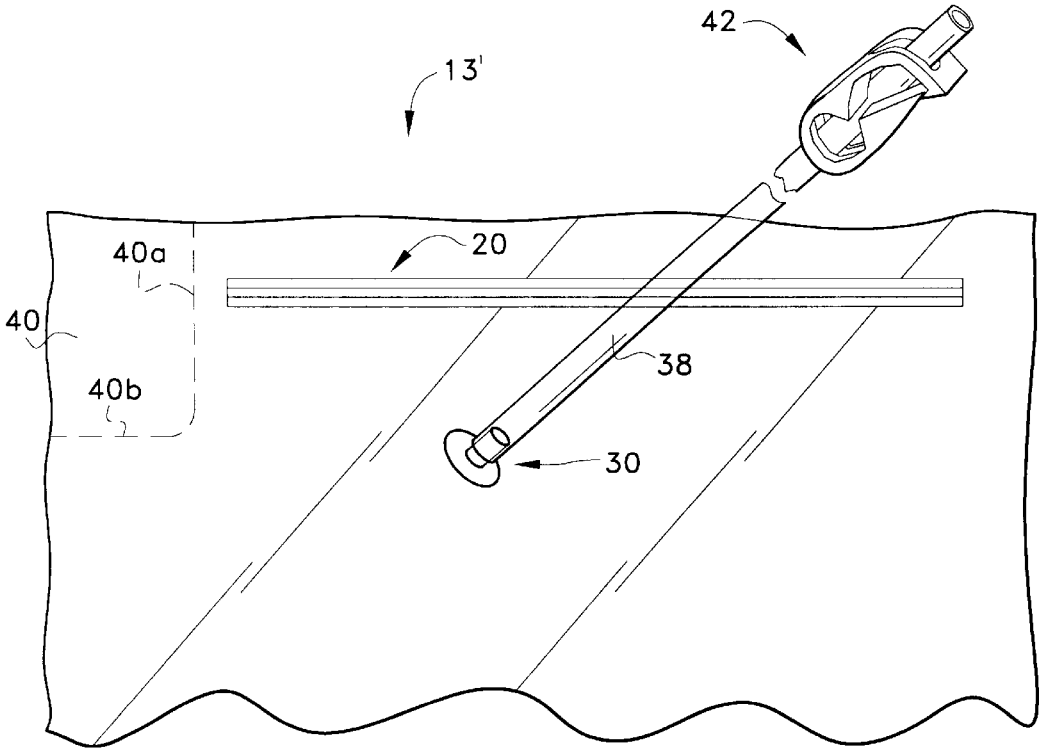
FIG. 2 is a partial side elevation view of the fillable disposable drink container having a clamped tube attached to the capped tubular extension in FIG. 1, and having an optional pocket with a puncture target for a drinking straw.
Figure 3:
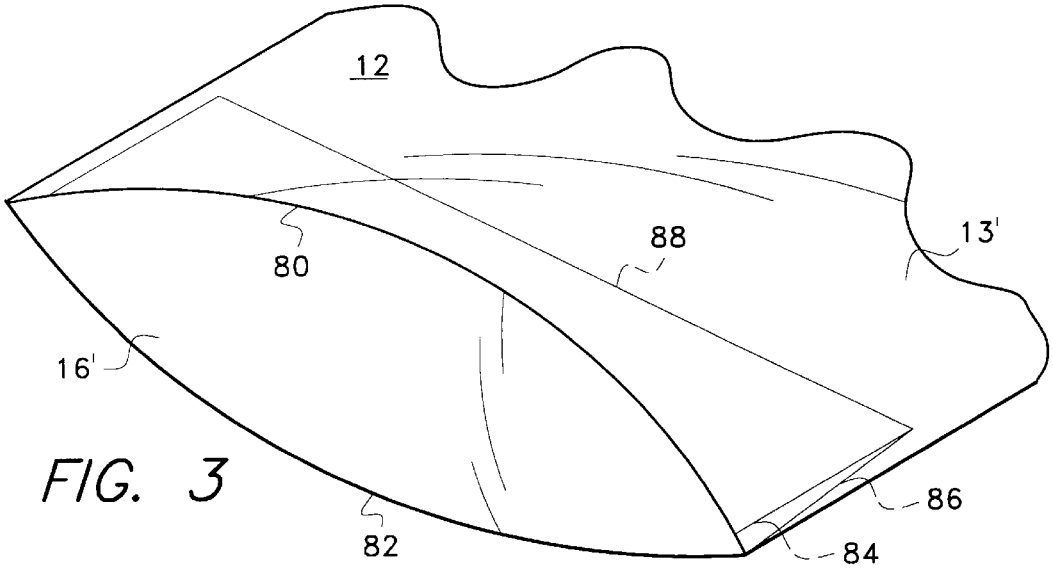
FIG. 3 is a partial side sectional view of the fillable disposable drink container having an expandable base according to a first embodiment.

Referring to FIG. 2, a transparent plastic tube or straw 38 is shown interconnected to the extension tube 30 with the cap 36 removed. In addition, an alternate embodiment of the container 13 is shown as container 13'. The container 13' illustrates an optional pocket 40 for inserting a straw within an alternate location by puncturing. The straw or tube 38 further comprises a compression clamp 42 which can be secured by the patient, dentist or a dental assistant depending on the stage of patient care or when the patient has had enough to drink. The base of this particular embodiment is shown in FIG. 3, as an alternate bottom 16' having an internal expandable cavity. It has been found that bottom 16' provides greater stability for the embodiment of container 13'. The front panel 12 has a bottom edge 80, and rear panel 14 has a bottom edge 82. Joined to the bottom edge 80 is an internal wall 84, and joined to the bottom edge 82 is an internal wall 86. Walls 84 and 86 are joined within the container 13' at a fold 88. Upon filling the container 13', the expansible base 16' spreads apart, ultimately allowing internal walls 84, 86 to form a substantially flat base. The resulting flat base allows the container 13' to stand in an upright position. It should be noticed, however, that either base can be used to provide the necessary function of the drink bag according to the invention.

Figure 4:
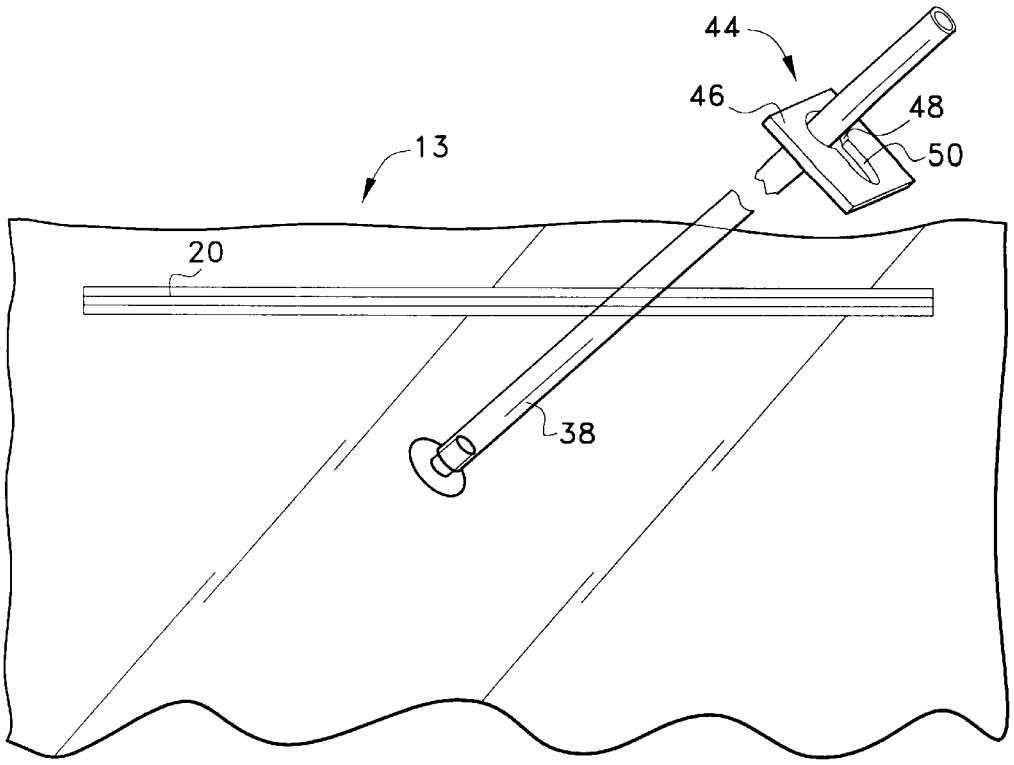
FIG. 4 is a partial side elevation view of the fillable disposable drink container having a clamped tube attached to the capped tubular extension in FIG. 1 according to a second embodiment.
Figure 5:
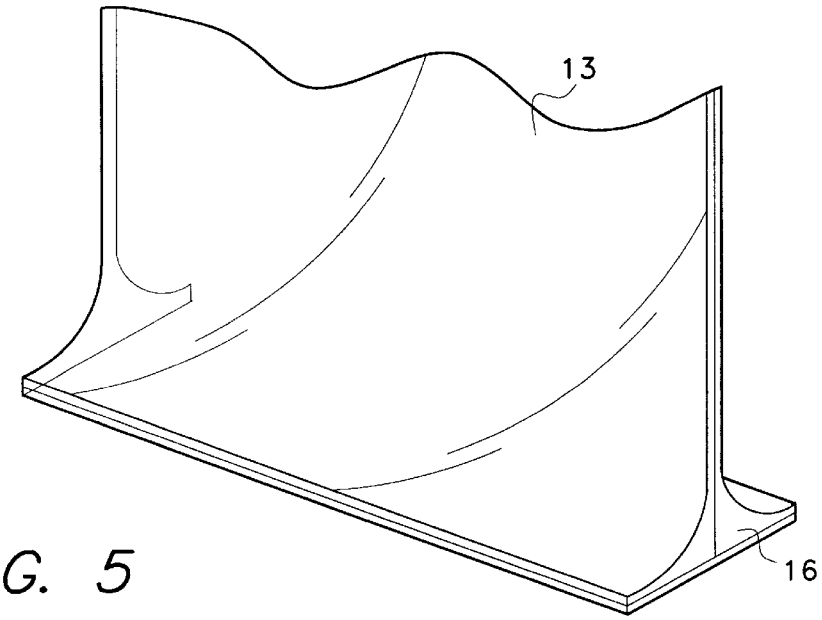
FIG. 5 is a partial side sectional view of the fillable disposable drink container having an non-expandable base according to a second embodiment.

Referring to FIG. 4, the container 13 is shown having the transparent plastic tube or straw 38 interconnected to the extension tube 30 as in FIG. 2, however, with an alternate clamp device 44 slidably attached thereto. The clamp 44 is an alternate means by which spillage is prevented in an inexpensive manner. The clamping device 44 is shown which comprises a ridged member 46 having a non-uniformly shaped aperture 48 passing therethrough. The aperture 48 includes a substantially circular portion with a connected tapered portion 50. A user may slide the clamping device 44 so that the circular portion thereof encircles the straw or tube 38, allowing a user to withdraw the contents of the container 13; or alternatively a user may slide the clamping device so that the tapered portion 50 pinches the straw closed, sealing the container to prevent a user from withdrawing the contents thereof. The base which correspond to this embodiment is similar to that of FIG. 1 and is displayed in cross-section in FIG. 5.

Figure 6:
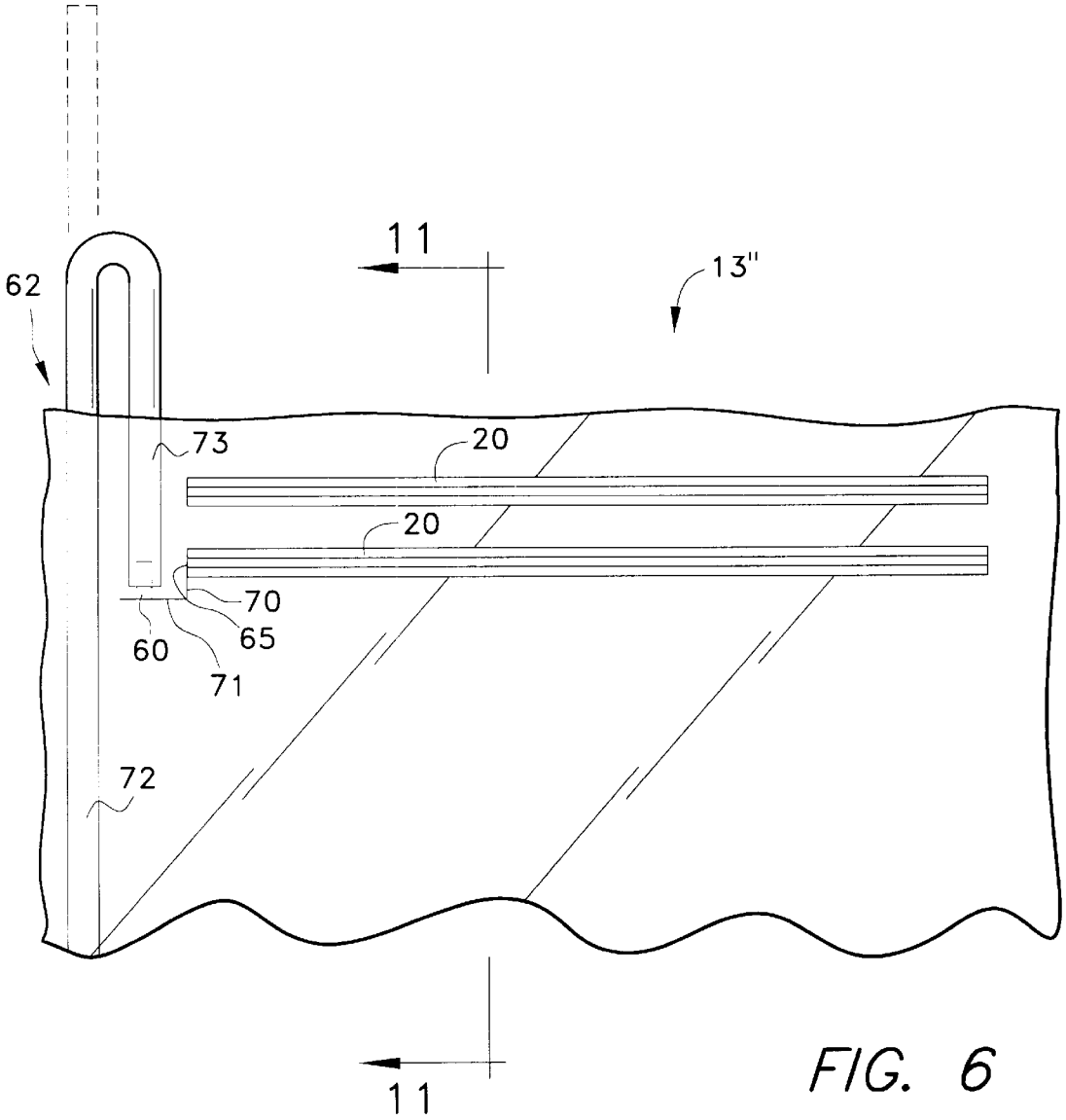
FIG. 6 is a perspective view of the fillable disposable drink container having a tubular extension and dual seals according to a second embodiment.

Referring to FIG. 6, an alternate embodiment of the invention is shown wherein an extension tube 60 is attached to the bottom of a pocket 62. Alteratively, an inverted cap (not shown) similar to cap 36 without strap 37 can be substituted for the extension tube 60. The pocket 62 is formed by having a pair of zipper closures 20 for dual seal protection, one of which extend only partially across the opening of the container 13". The pocket 62 effectively couples the upper panel 12 to the lower panel 14 proximate the terminus 65 of the zipper closures 20 along a line 70 parallel to the peripheral edge of the container and as well as along an adjoining line 71 parallel to the zipper closures 20. An upper end 73 of the straw 72 is fitted onto the extension tube or post 62 when the straw 72 is being transported or otherwise not in use.

Figure 7:
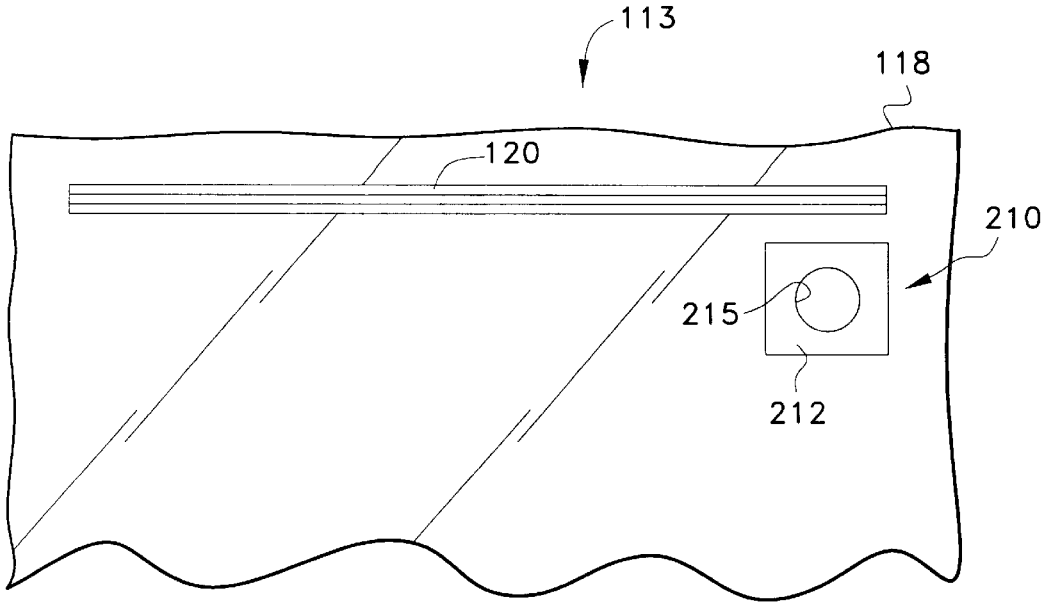
FIG. 7 is a partial side elevation view of the fillable disposable drink container with an alternate arrangement of a puncture target according to the invention.
Figure 9:
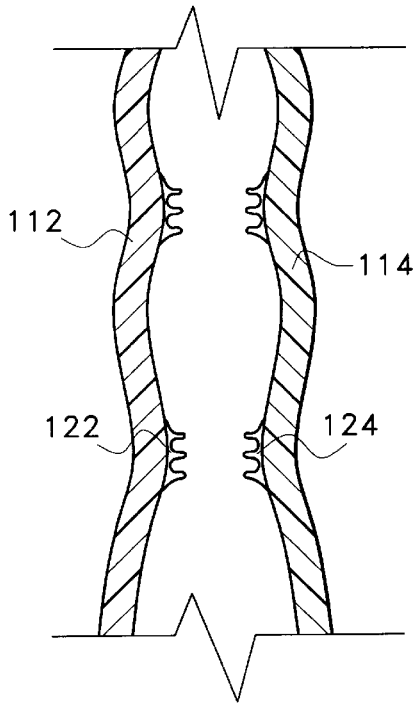
FIG. 9 is a cross-sectional view of the fillable disposable drink container taken along line 11—11 in FIG. 6.

Referring now to FIGS. 7 and 9, a container 113 according to a second embodiment is shown. The container 113 is formed by coupling a flexible lower panel 114 to a flexible upper panel 112 along the outer peripheral edges thereof so as to define an expansible space between the upper panel 112 and the lower panel 114. The container bottom 116 is pleated making it capable of supporting the container 113 in an upright position. The container 113 may or may not be a pleat. The panels 112, 114 are uncoupled relative to one another along an upper end 118 thereof to define an opening through which the container 113 may be filled.

The open end 118 of the container 113 is sealed by a zipper closure 120 extending across the open end 118 of the container 113. The zipper closure 120 comprises a first sealing strip 122 coupled to the interior surface of the upper panel and a second sealing strip 124 coupled to the interior surface of the lower panel 114 and positioned for interlocking engagement with the first sealing strip 122.

Referring to FIG. 9 a puncture target 210 is coupled to the exterior of the container 113. The puncture target 210 is a patch 212 made from flexible thin sheet material having an adhesive applied to one side thereof. The target 215 is an aperture in the center of the patch 212 which is specifically adapted to receive a straw (not shown). The aperture of target 215 may contain a translucent thin sheet material (not shown) so that the patch 212 may be placed over an existing puncture or re-used containers. Alternatively, the puncture target 210 can be an indicia (not shown) placed on the exterior of the container 113 which can be resealed by an adhesive puncture target 210. The straw is specifically adapted to puncture the container 113 through the puncture target 210 and made to be in fluid communication with the interior of the container 113.

With respect to FIG. 2, the puncture target 210 can also be located within the pocket 40. The pocket 40 is formed by having the zipper closures 20 extend only partially across the opening of the container. The pocket 40 effectively couples the upper panel 12 to the lower panel 14 proximate the terminus 25 of the zipper closures 20 along a line 40*a* parallel to the peripheral edge of the container 13 and coupling the upper panel 12 to the lower panel 14 along an adjoining line 40*b* parallel to the zipper closure 20. To facilitate puncturing of the container with straw a tube (not shown) may be sealed within the pocket 40 and extend into the interior of the container 13. One end of the tube extending into the interior of the container 13 is covered by a translucent sheet material which prior to its being punctured seals the tube.

The puncture target 210 can be used for resealing a previously punctured liquid container or providing a puncture target for liquid containers without them.

It is to be understood that the present invention is not limited to the embodiments described above, but encompasses any and all embodiments within the scope of the following claims.

What is claimed is:

1. A drink container comprising:

a flexible front panel having a top, a bottom and side edges;

a flexible rear panel having a top, a bottom, and side edges, said rear panel being joined to said front panel along each of said side edges to define a top opening;

an expansible base intimately connected to said front and rear panel along the bottom, said expansible base being capable of supporting said container in an upright position;

a zipper closure extending across the top of each said front and rear panel, said zipper closures comprising a first sealing strip and a second sealing strip for interlocking engagement with said first sealing strip;

a fluid passage disposed through said front panel adjacent the top;

a heat-sealed tube extending from said fluid passage; and a tubular conduit coupled to said heat-sealed tube, wherein said tubular conduit includes sealing means for sealing one end of said conduit.

2. The expansible and fillable drink container according to claim 1, wherein said base includes a pleat.

* * * * *